United States Patent [19]

de Angelis

[11] 4,242,805

[45] Jan. 6, 1981

[54] METHOD AND APPARATUS FOR DRYING A THICK WET LAYER COATED ON ONE FACE OF A CARDBOARD SHEET

[75] Inventor: Henri de Angélis, Macon, France

[73] Assignee: Service d'Exploitation Industrielle des Tabacs et des Allumettes, Paris, France

[21] Appl. No.: 53,795

[22] Filed: Jul. 2, 1979

[30] Foreign Application Priority Data

Jul. 7, 1978 [FR] France ..... 78 20245

[51] Int. Cl.[3] ..... F26B 3/34

[52] U.S. Cl. ..... 34/1; 219/10.41; 219/10.61 R; 219/10.81; 427/45.1; 118/620

[58] Field of Search ..... 219/10.61, 10.81, 10.69, 219/10.41; 118/620; 427/45.1; 34/1

[56] References Cited

U.S. PATENT DOCUMENTS

| | | | |
|---|---|---|---|
| 2,588,218 | 4/1952 | Dippel et al. | 34/1 |
| 2,678,897 | 5/1954 | Mann et al. | 34/1 |
| 3,681,558 | 8/1972 | Grassman | 34/1 |
| 3,740,257 | 6/1973 | Roscher | 34/1 |
| 3,859,494 | 1/1975 | Spengler | 34/1 |

FOREIGN PATENT DOCUMENTS 730782 1/1943 Fed. Rep. of Germany .

*Primary Examiner*—Larry I. Schwartz
*Attorney, Agent, or Firm*—Sandler & Greenblaum

[57] ABSTRACT

A method for drying a thick wet layer coated on one face of a cardboard sheet, the method being, of the type in which the coated cardboard sheet is fed continuously and a high frequency electric field is applied thereto in such manner that the lines of force of said electric field go only through said thick layer to selectively heat said layer, wherein a further electric field is applied to the coated cardboard sheet in such manner that the lines of force thereof go at least through the cardboard sheet. The method includes starting to apply the further electric field before the first mentioned electric field is applied. Apparatus for performing the method is additionally provided, the apparatus including at least one pair of oppositely polarized electrodes positioned along one face of the cardboard sheet and a second pair of oppositely polarized electrodes positioned along the opposed face of the cardboard sheet.

4 Claims, 4 Drawing Figures

METHOD AND APPARATUS FOR DRYING A THICK WET LAYER COATED ON ONE FACE OF A CARDBOARD SHEET

BACKGROUND OF THE INVENTION

1. Technical Field of the Invention

The invention relates to a method for drying a thick wet layer coated on one face of a cardboard sheet, the method being of the type in which the coated cardboard sheet is fed continuously and a high frequency electric field is applied thereto in such manner that the lines of force of said electric field go only through said thick layer to selectively heat said layer.

2. Discussion of the Prior Art

There is disclosed in German Pat. No. 730,782 an apparatus for selectively drying by high frequency heating the surface portion of a plate. This apparatus comprises two electrodes of opposite polarities disposed along the longitudinal side edges of the plate. With such an arrangement, the lines of force of the high frequency electric field concentrate in the surface portion and a selective drying is achieved.

The drying thus obtained is so active and rapid, however, that ionized particles tend to be attracted out of the layer by field effect so that they are deposited on the electrodes and stain the same.

SUMMARY OF THE INVENTION

The object of the invention is to obviate such a defect.

There is provided according to the invention a method of the type specified above, wherein a second, further electric field is applied to the coated cardboard sheet in such manner that the lines of force thereof go at least through the cardboard sheet itself. The method includes starting to apply said further electric field before said first mentioned electric field is applied.

The application of a further electric field results in improving the adhesion of the thick layer to the cardboard substrate before the drying step itself begins, which overcomes the above described drawback.

In accordance with another aspect of the invention, there is provided an apparatus for drying a thick wet layer coated on one face of a cardboard sheet, the apparatus comprising means for continuously feeding the coated cardboard sheet along a first pre-determined path and a high frequency electric field applicator including two electrodes of opposite polarities facing said layer in parallel relationship to the feed direction of the sheet, on either side of said layer, wherein there is provided a second high frequency electric field applicator including two electrodes of opposite polarities disposed on the side remote from said layer and substantially facing the electrodes of said first mentioned applicator, respectively, the electrodes of said further applicator extending beyond those of said first mentioned applicator on the entrance side of the apparatus.

BRIEF DESCRIPTION OF THE DRAWINGS

The invention will be more readily understood on reading the following description with reference to the accompanying drawings, in which.

DETAILED DESCRIPTION OF THE DRAWINGS

The apparatus described below is an apparatus for drying slabs of friction composition coated on a cardboard sheet in order to produce match boxes provided with friction strips to allow matches to be ignited.

The friction composition comprises, inter alia, phosphorus, water and a thermosetting binder. The step of coating slabs of friction composition on a cardboard substrate takes place at a very high speed and it is critical that drying of these slabs can occur at the same high speed. Furthermore, the cardboard sheet itself contains a certain amount of water.

Figure 1:
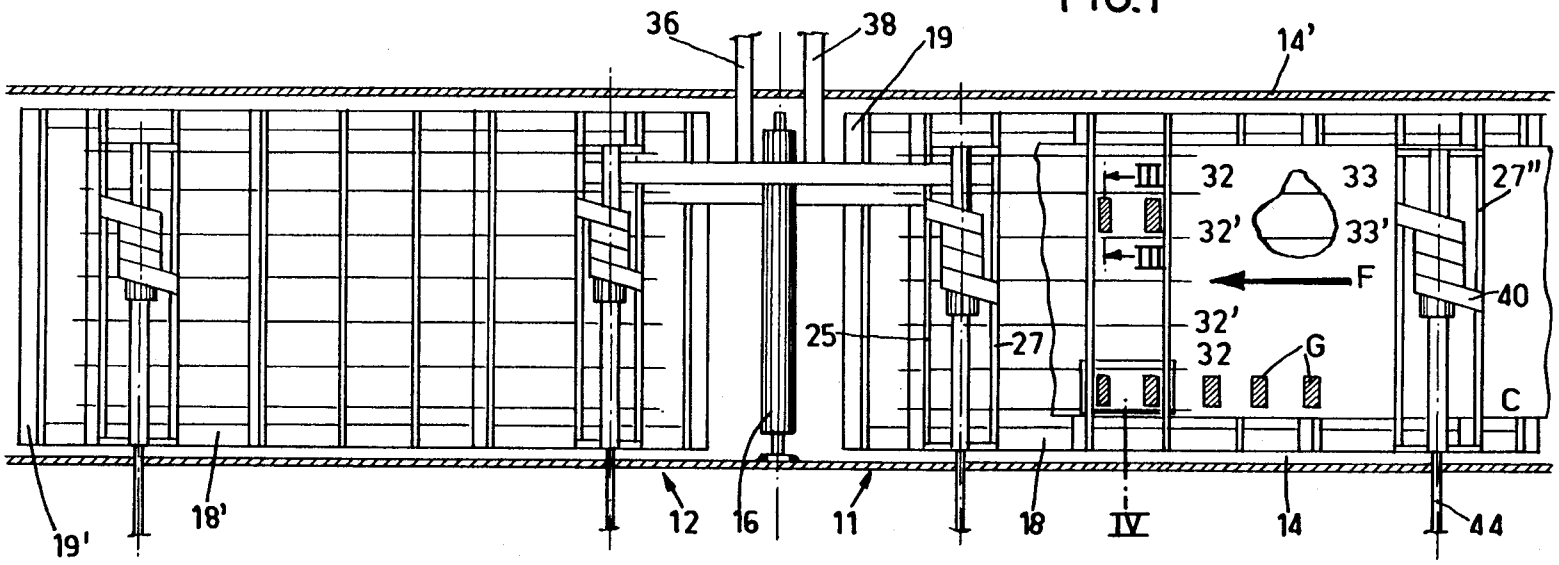
FIG. 1 is a plan view of a drying apparatus according to the invention.
Figure 2:
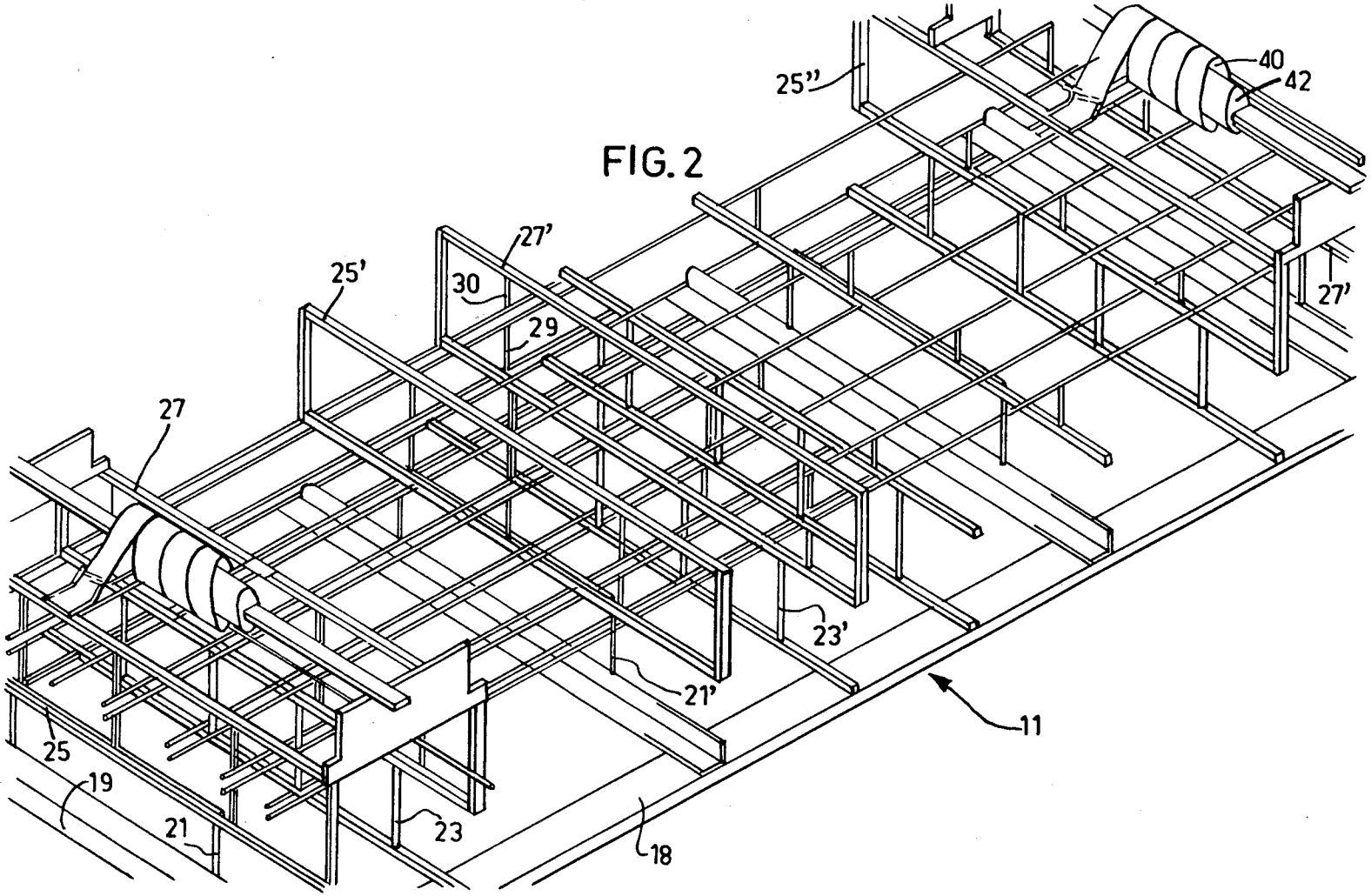
FIG. 2 is a perspective view of part of the drying apparatus.

Referring now to the drawings, FIG. 1 shows a drying apparatus which is composed of two similar parts 11 and 12. The whole apparatus is enclosed in a protecting tunnel of which only the two vertical walls 14 and 14' are seen in section. The sheet of cardboard C having slabs of friction composition G to be dried coated thereon, enters from the right portion of the apparatus as seen in FIG. 1 into part 11 (and from the upper right-hand corner in FIG. 2) and travels in the direction of arrow F, passing over the support 16 passing through part 12. Each of the parts is supported on a rigid chassis 18, 19 (18', 19') composed of steel sections. On this chassis are mounted, by means of insulating plates 21, 21' or insulating bars 23, 23', equipotential frames 25, 25', 25'' . . . and 27, 27', 27'' . . . (FIG. 2). These frames support electrodes forming electric field applicators via the uprights or conducting supports such as 29 and 30. The thick wet layer is coated on one face of the cardboard sheet, the sheet having two opposed side edges and two faces.

Figure 3:
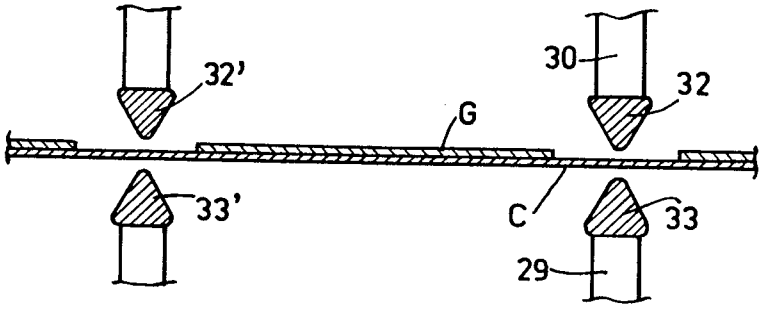
FIG. 3 is a detailed section-view, taken along lines III—III of FIGS. 1 and 4, showing the arrangement of two pairs of electrodes.

As may be seen in FIG. 3, a first pair of two electrodes 32 and 33, connected to the same frame by a support 30 and an upright 29 aligned with each other, leave a space therebetween to allow easy passage of the cardboard sheet C. These electrodes are of same polarity whilst the second pair of adjacent electrodes 32' and 33' (on either side) have a polarity opposite from that of electrodes 32 and 33. The electrodes of each pair are positioned or disposed along the opposite edges of the sheet, one electrode of each pair thereby being located along one side edge and the other electrode of each pair being located along the other side edge of the sheet. The electrodes of each pair which are located along the same side edge are of the same polarity. Each pair of electrodes is located along the sides of the sheets in parallel relation to the direction in which the sheet is fed and passed through the apparatus.

In each part of the drying apparatus there are provided three pairs of electrodes having the same polarity as electrodes 32 and 33 and four pairs of electrodes having the same polarity as electrodes 32' and 33'.

Figure 4:
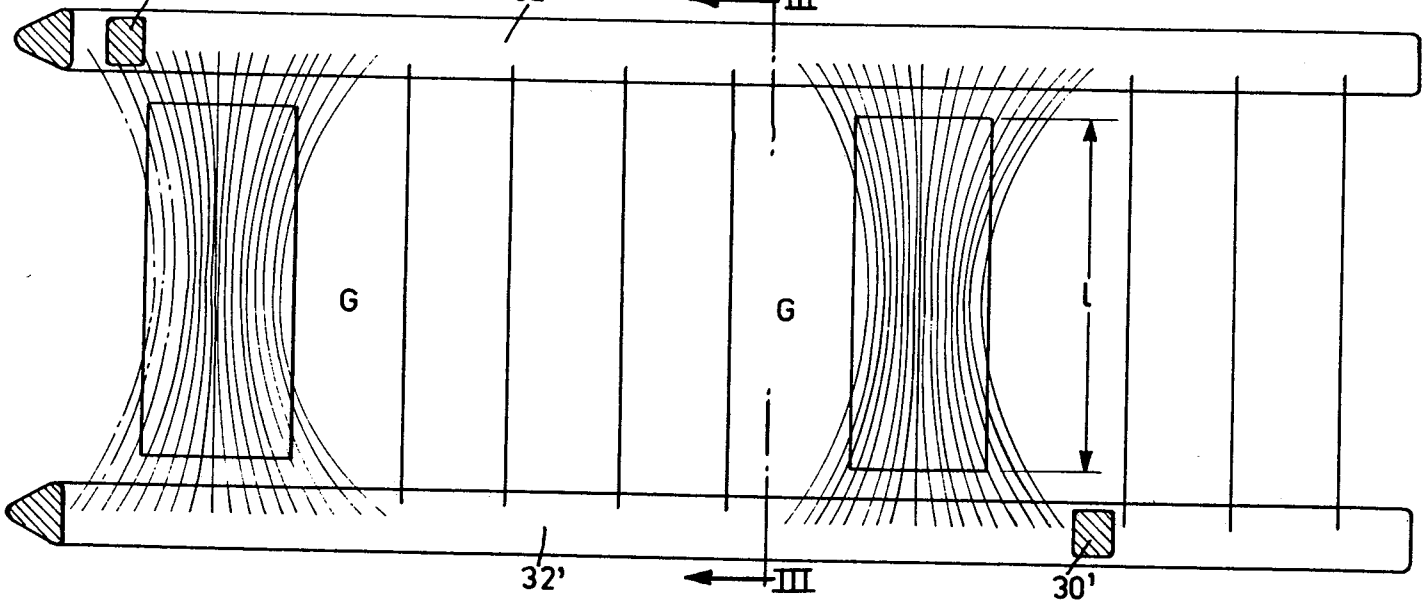
FIG. 4 is a plan diagram showing the distribution of the electric field derived from the upper electrodes in the slabs of friction composition (detail IV of FIG. 1).

The cardboard sheet C has coated thereon six rows of slabs of friction composition G which are fed between respective pairs of electrodes. These slabs are spaced apart as shown in FIGS. 1 and 4 as, after the cardboard sheet C has been divided into six strips, the outer casings of match boxes are here formed by cutting out and folding along lines perpendicular to arrow F. The coating could, on the contrary, be continuous (and the electrodes 32 and 32' closer to each other) if the folding of the outer casings were made along lines parallel to said arrow. The distance between two electrodes of opposite polarity 32 and 32' is slightly greater than the width "l" of the friction slab (FIG. 4) with the result that the cardboard sheet may slightly depart from its feed direction without the wet matter coming too close to the upper electrodes.

In the two parts 11 and 12 of the drying apparatus, there are therefore two beds of superposed electrodes 32 and 33. However, it will be noted in FIG. 1 that the upper bed of electrodes 32, 32' . . . extends only over the second half (downstream half) of the head part 11 of the apparatus. The electrodes 33, 33' . . . of the lower bed, as may be seen by the cut-out made in the cardboard sheet C, extend up to the entrance portion of the apparatus, slightly beyond the equipotential frame 27''.

The current supply of the equi-potential frames 25 and 27, of one of the other polarity, is effected from a high frequency generator (not shown) via the bars 36 and 38. Self inductance coils such as 40, by which the magnetic core 42 may be displaced by means of control rods 44, connect certain pairs of frames of opposite polarities. The displacement of the cores 42 enables the circuit constituted by the electrodes and the dielectric present therebetween (including the friction slab to be dried) to be tuned to the frequency of the generator. The inductance coils also enable the power dissipated to be distributed in optimum manner and a progressive drying to be achieved.

The apparatus operates as follows:

The cardboard sheet C carrying six rows of friction composition slabs such as G is introduced in the part 11 of the drying apparatus above the bed of electrodes 33, 33' . . . at an entrance side of the apparatus and a predetermined path of travel of the sheet. It is taken along said predetermined path through parts 11 and 12 by drive and guide means of known type, including the support roller 16, in the direction of arrow F, in order to pass beneath the bed of upper electrodes 32, 32'. It may be that, in the half of the spans between the roller 16 and the inlet or outlet rollers, the cardboard sheet C contacts the lower bed of electrodes, but this is not troublesome as the sheet is then sufficiently dry to possess a good insulation propriety.

As soon as the cardboard sheet enters the part 11 of the drying apparatus, the alternate electric field established between the electrodes 33 and 33', produce in the wet portions of the cardboard sheet, mainly beneath the friction slabs G, charge movements which result in a rapid heating of these portions. Therefore, drying (or prepolymerization) of the binder in the boundary zone between the cardboard sheet and the friction slab occurs first, this providing perfect adhesion of the slabs on the cardboard sheet. Then, when the friction slabs pass between the electrodes 32, 32' of the upper bed, the lines of force of the electric field concentrate in the wettest parts, as indicated in FIG. 4. The friction slabs therefore receive a considerable electrical energy, all the more so as the air gap provided between the electrodes and the side edge of the slabs is smaller. The loss of energy into the air will therefore be greatly reduced and the yield excellent.

When the sheet passes electrodes 33 and 33' of the first high frequency electric field applicator, the lines of force created thereby pass at least through the cardboard sheet. Thereafter, the sheet passes electrodes 32 and 32' of the second high frequency electric field applicator, and the lines of force pass only through the wet layer to selectively heat the layer.

The heating of the friction slabs will therefore be rapid and, accordingly, will be compatible with the high coating speed specified above and, despite this, progressive, since it will be concentrated in the parts which will need it most. A sweeping of the upper electrodes with air will accelerate drying and will prevent condensation and deposit of dust. With suitably adjusted power, the cardboard will remain flexible enough to be folded without degradation.

While the invention in described in reference to a specific application, it should be understood that it is not limited to such an application as other materials for the layer coated on the cardboard substrate could be contemplated.

What is claimed is:

1. A method for drying a cardboard sheet having two opposed side edges and two faces, said sheet having a thick wet layer coated on one of said faces, said method comprising:

(a) feeding said cardboard sheet continuously along a predetermined path;

(b) applying a first high frequency electric field to said sheet such that the lines of force of said electric field penetrate only said thick layer to selectively heat said layer; and (c) further applying a second electric field to said sheet such that the lines of force of said second electric field penetrate through at least said cardboard sheet, whereby the application of said second electric field begins before the application of said first electric field.

2. Apparatus for drying a thick wet layer coated on one face of a cardboard sheet which has two opposed side edges and two faces, said apparatus comprising:

(a) means for continuously feeding said sheet along a predetermined path, said path and said apparatus including an entrance side;

(b) a first high frequency electric field applicator, said applicator including a first pair of two electrodes of opposite polarities facing said one face of said sheet on which said layer is coated, one of said electrodes being disposed along one side edge of said sheet and the other of said electrodes being disposed along the other side edge of said sheet in parallel relation to the direction in which said sheet is fed; and (c) a second high frequency electric field applicator including a second pair of two electrodes of opposite polarities facing the face of said cardboard sheet on which said thick wet layer is not coated, one of said electrodes being disposed along one side edge of said sheet and the other of said electrodes being disposed along the other side edge of said sheet in parallel relation to the direction in which the sheet is fed, such that the electrodes of each pair located along said one side edge of the sheet are of the same polarity and the electrodes of each pair located along the other side edge of the sheet are of the same polarity, and wherein said electrodes of the second applicator are closer to said entrance side than said electrodes of said first applicator.

3. An apparatus according to claim 2, wherein both of said applicators are connected to one high frequency current generator.

4. An apparatus according to claim 2 wherein said layer comprises a plurality of rows of slabs coated on said sheet and each of said electrode pairs is spaced apart by a distance greater than the width of each of said slabs.

* * * * *

UNITED STATES PATENT AND TRADEMARK OFFICE

CERTIFICATE OF CORRECTION

PATENT NO. : 4,242,805

DATED : January 6, 1981

INVENTOR(S) : Henri de Angelis

It is certified that error appears in the above—identified patent and that said Letters Patent is hereby corrected as shown below:

In the abstract, line 2, after "being", "," should be deleted.

Column 1, line 48, "first" should be deleted; and
line 49, after "a", --first-- should be inserted.

Column 2, line 30, "passing" (second occurrence) should be --and--.

Column 3, line 19, "of" (second occurrence) should be --and--;
line 39, after "32'", --...-- should be inserted;
line 44, "propriety" should be --property--; and
line 47, after "33'", "," should be deleted.

Column 4, line 10, "in" (first occurrence) should be --is--.

Signed and Sealed this

*Twenty-first* Day of *April 1981*

[SEAL]

*Attest:*

RENE D. TEGTMEYER

*Attesting Officer*

*Acting Commissioner of Patents and Trademarks*